United States Patent [19]

Ross

[11] Patent Number: 4,570,286

[45] Date of Patent: Feb. 18, 1986

[54] PORTABLE VACUUM CLEANING DEVICE

[76] Inventor: David Ross, 1 Louisiana Ave., Lakehopatcong, N.J. 07849

[21] Appl. No.: 631,756

[22] Filed: Jul. 17, 1984

Related U.S. Application Data

[62] Division of Ser. No. 428,650, Sep. 30, 1982, Pat. No. 4,476,607.

[51] Int. Cl.[4] ..... A47L 5/36

[52] U.S. Cl. ..... 15/327 C; 15/327 F; 15/344

[58] Field of Search ..... 15/327 F, 327 C, 339, 15/257 B, 344

[56] References Cited

U.S. PATENT DOCUMENTS

| | | | |
|---|---|---|---|
| 1,859,132 | 5/1932 | Fechtenburg | 15/402 |
| 2,122,632 | 7/1938 | Baxter | 15/327 F X |
| 2,587,991 | 3/1952 | Gerber | 15/257 B X |
| 2,624,061 | 1/1953 | Leas | 15/414 X |
| 3,015,336 | 1/1962 | Caples | 15/415 R X |
| 4,132,507 | 1/1979 | Akiyama et al. | 15/344 X |

FOREIGN PATENT DOCUMENTS

| | | | |
|---|---|---|---|
| 1096006 | 12/1960 | Fed. Rep. of Germany | 15/415 A |
| 1484856 | 5/1967 | France | 15/339 |

*Primary Examiner*—Chris K. Moore
*Attorney, Agent, or Firm*—Eric P. Schellin

[57] ABSTRACT

A lightweight portable vacuum cleaner and attachment nozzle are disclosed which may be readily carried by an operator to vacuum both normally accessible and normally inaccessible areas. The vacuum cleaner comprises an elbow-shaped plastic housing which encloses a filter bag and blower motor. The vacuum is carried under the arm of the operator supported from a strap that goes over the operator's shoulder. A deodorant chamber is mounted to the exhaust screen of the housing, so that exhaust from the blower motor can be used to distribute scented odor over the surface that is being cleaned. In addition, footings are mounted adjacent to the exhaust screen so that proper ventilation is assured for the blower motor. A flexible hose with suction tube is frictionally fitted into an aperture in the vacuum cleaner and thereby delivers suction to the area at which they are directed. A specific attachment nozzle is coupled to a 45° coupling which is coupled to the suction tube. The attachment nozzle is arranged longitudinally to the suction tube thereby permitting the opertor to vacuum in a sweeping side-to-side motion. The attachment nozzle comprises a cylindrical plastic tube into which longitudinal slots are cut which direct suction to the area to be cleaned. A closed end of the plastic tube is fitted with a permanent magnet to pick up metal articles. In addition, the attachment nozzle is provided with prongs for loosing material trapped in the fibrous material of carpets.

16 Claims, 6 Drawing Figures

FIG. 3
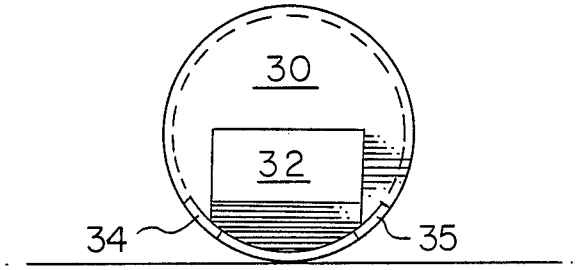
FIG. 4
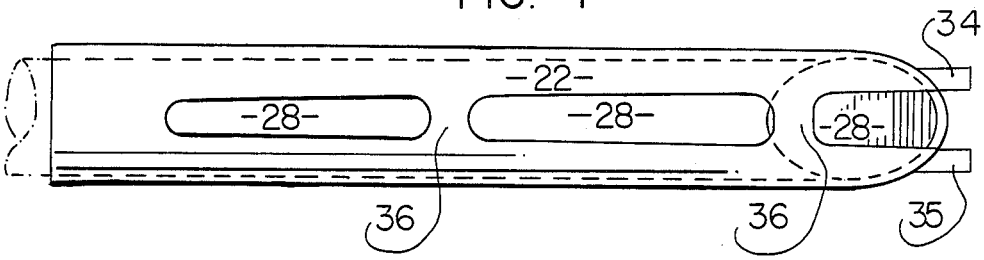
FIG. 5
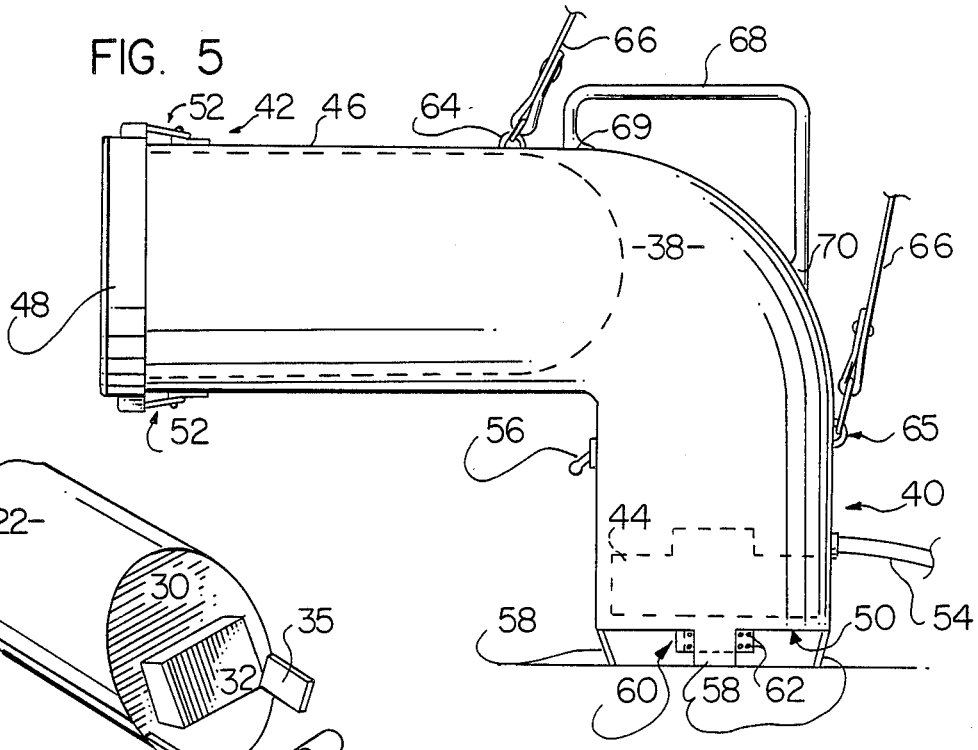
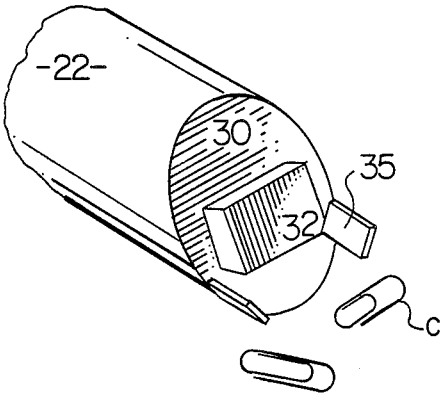
FIG. 6

PORTABLE VACUUM CLEANING DEVICE

This is a division of application Ser. No. 428,650 filed Sept. 30, 1982, now U.S. Pat. No. 4,476,607 issued 10/16/84.

BACKGROUND OF THE INVENTION

1. Field of the Invention:

The present invention relates to a lightweight portable vacuum cleaner which may be readily carried by the operator. In addition, a specific attachment nozzle is utilized with this vacuum cleaner to further facilitate its flexibility of operation.

In cleaning large office buildings a number of cleaning crews are used which clean the offices after regular business hours. To increase the efficiency of the crews, vacuum cleaners that are highly portable and lightweight are needed so that crews can move from one office to another quickly. Conventional vacuum cleaners which are mounted on rollers or casters have proved cumbersome because of their weight and lack of maneuverability when cleaning a cluttered office. In addition, many areas prove inaccessible to these vacuum cleaners because of their weight and bulkiness, thereby preventing a thorough vacuuming job.

Specific features that can be built into such vacuum cleaners include the use of transparent suction tubes, as illustrated by Cannan, U.S. Pat. No. 3,919,729, and using the exhaust of a vacuum cleaner for delivering foam to the surface to be cleaned, as illustrated by Crener, U.S. Pat. No. 3,633,240.

The attachment nozzles through which the vacuum is applied to the surface to be cleaned have also proven to be clumsy. Attachment nozzles are coupled to the suction tube of a vacuum cleaner and are placed in contact with the surface to be cleaned thereby applying suction to the surface. The attachment nozzles have slots through which the vacuum is applied and these slots are oriented so as to be perpendicular or lateral to the orientation of the suction tube. The operator controls the placement of the attachment nozzle, and thereby the application of the vacuum, by controlling the movement of the suction tube to which the nozzle is coupled. As such, the perpendicular orientation of the slots dictates that the operator must push and pull the vacuum forward and backward to achieve the maximum vacummed area. Casters and wheels, and even the weighting of the attachment and suction tube further dictate this push and pull movement.

Attachment nozzles has been adapted to facilitate various operations. Swanson et al, U.S. Pat. No. 2,862,224, uses a magnet mounted on a floor surfacing machine to pick up steel particles located on the floor. Scraper brushes have been attached to the attachment nozzles for scraping or moving rug pile so to better effectuate vacuuming. Such devices are illustrated by Riebel, Jr., U.S. Pat. No. 1,990,710, Ego, U.S. Pat. No. 2,879,430, Martinec, U.S. Pat. No. 2,893,048, Jepson et al, U.S. Pat. No. 3,203,023, and Cyphert, U.S. Pat. No. 4,019,218.

The present invention overcomes the above-presented problems by disclosing a operator-carried vacuum cleaner to which is coupled an attachment nozzle specifically adapted for side-to-side movement. The nozzle is light and can be used to readily service normally inaccessible areas. In addition, the nozzle is provided with prongs for dislodging articles entrained in carpeting; and a magnet for picking up metal articles present on the vacuumed surface.

SUMMARY

The present invention comprises an elbow-shaped lightweight vacuum cleaner that is carried by the operator. The elbow-shaped housing outlining the vacuum encases the vacuum blower motor and a filter bag through which air sucked into the housing during vacuuming is filtered. The blower is mounted in the first leg of the elbow and the filter bag is mounted in the second leg of the housing. The vacuum is carried by a strap which is secured to both legs of the elbow and which passes over the shoulder of the operator. The vacuum is then carried under one arm of the operator freeing the operators hands for controlling the suction tube of the vacuum. A flexible hose is frictionally fitted into an aperture on the second leg of the elbow adjacent to the filter bag. The other end of the hose is coupled to a suction tube which is also coupled to the attachment nozzle.

The attachment nozzle comprises a cylindrical tube which is open at one end where it is coupled to the suction tube; and closed at its other end. The vacuum supplied through the suction tube is delivered to the surface to be cleaned by longitudinally extending slots located on one side of the cylindrical tube. The attachment tube is coupled to the suction in a longitudinal fashion whereby the slots are aligned with the suction tube. This unique orientation and construction eliminates the necessity of a push-pull motion as presented in the prior art and permits a side-to-side motion. The operator by controlling the movement of the suction tube would move the nozzle side-to-side in an arcuate fashion to cover large areas, and because of its small size the operator can reach what were until now, inaccessible areas.

The cylindrical tube is also provided with prongs and a magnet at its closed end to facilitate the pickup of articles, especially paper clips, and staples entrained in carpeting. Pickup of paper clips in the office environment has been especially difficult because the paper clip and staples gets tangled in the fiber of the carpet. The prongs are used to work an entrapped paper clip or staple loose after which the magnet can pick up the clip or staple by magnetic attraction. By mounting prongs at the end of the attachment tube the operator no longer has to bend over to release a trapped paper clip and can, by manipulating the nozzle work a paper clip loose, where it may be picked up by the magnet.

Both the attachment nozzle and the suction tube are made of transparent plastic materials because of its light weight and to enable the operator to monitor the flow of materials in the vacuum. The vacuum housing is also formed out of a plastic material because of its light weight.

The vacuum itself may be provided with a deodorant cannister that is connected to the first leg of the elbow so that exhaust from the blower would deliver a deodorant odor or a scented powder throughout the vacuumed area. The first leg is also provided with footings so that the exhaust exit of the blower cannot be placed flush against anything which would not allow for proper ventilation of the motor.

BRIEF DESCRIPTION OF THE DRAWINGS

FIG. 3, is a bottom plan view of the attachment nozzle;

FIG. 4, is a front view of the attachment nozzle;

FIG. 5, is a side plan view of the vacuum cleaner; and

FIG. 6, is a perspective view of the front of the attachment nozzle picking up paper clips.

DETAILED DESCRIPTION OF THE PREFERRED EMBODIMENTS

Figure 1:
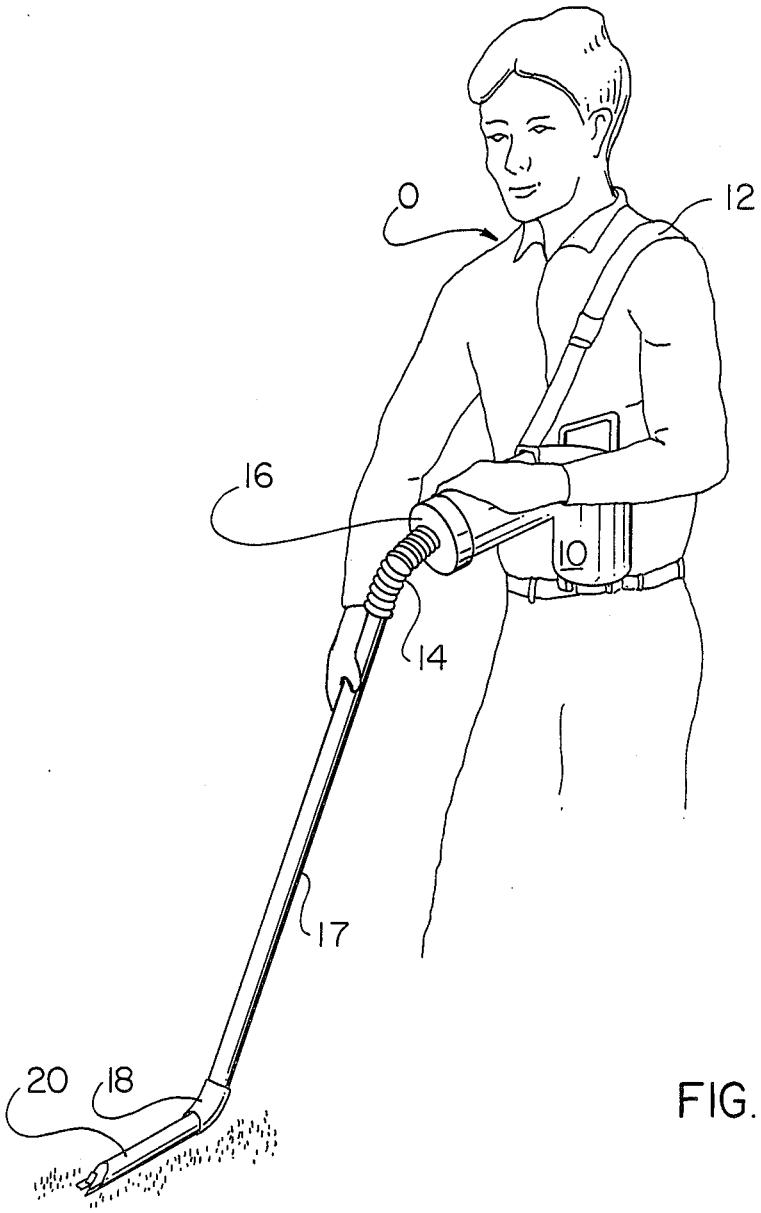
FIG. 1, is a perspective view of an operator using the subject vacuum cleaner.

As illustrated in FIG. 1, operator O carries vacuum cleaner 10 under his arm. Vacuum cleaner 10 is supported by carrying strap 12 which is draped over the operator's shoulder. Flexible hose 14 is coupled to cleaner 10 at an aperture in removable cover 16. The other end of flexible hose 14 is coupled to suction tube 17 which is formed of a transparent plastic. At the other end of suction tube 17 is a 45° coupling 18 to which is coupled attachment nozzle 20. To keep the assembly as light as possible the vacuum cleaner housing, the flexible hose, the suction tube and attachment nozzle are formed out of plastic.

As can be readily understood from the Figure 1, operator O vacuums the surface to be cleaned by moving attachment nozzle 20 in a sweeping motion from side-to-side instead of a push-pull motion as in conventional vacuum cleaners. These type of motion requires less physical effort than the push-pull motion, because only the lower arm must be moved to complete a sweep whereas in a conventional push-pull motion the total arm, shoulders and upper torso must be moved to complete the motion. In addition, the present attachment nozzle can reach a number of inaccessible places, such as between a desk and a wall and other narrow places that a conventional nozzle attachment cannot reach. Furthermore, because of its lightweight nature, overhead ceiling and wall vents can be vacuumed, and complete walls and ceilings that would ordinarily not be vacuumed by a standard vacuum and nozzle because of their cumbersome nature.

Figure 2:
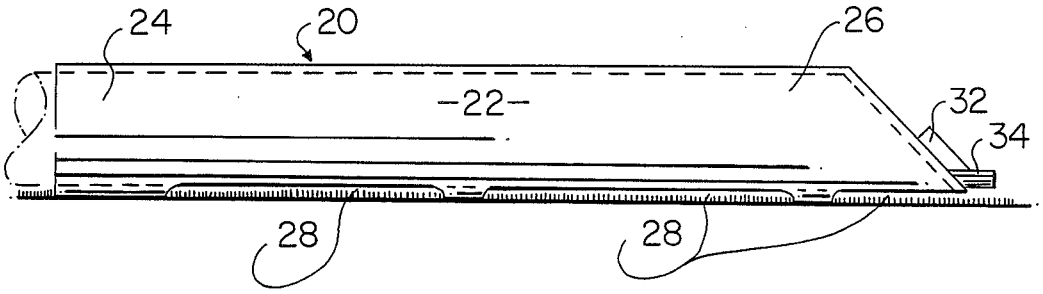
FIG. 2, is a side plan view of the attachment nozzle.

Attachment nozzle 20 better illustrated in FIGS. 2, 3 and 4, comprises cylindrical tube 22 having first end 24, second end 26 and longitudinally disposed slots 28. First end 24 is open and is coupled to coupling 18, as illustrated in FIG. 1. Second end 26 is closed by covering plate 30. The second end is canted as illustrated at a 45° angle so that the attachment nozzle may more easily slide under objects, for example sofas. At the base of covering plate 30 is permanent magnet 32 which is used for picking up metal objects on the surface to be cleaned. Prongs 34 and 35 comprising a prong means that extends to forward edge covering plate 30.

The attachment nozzle is formed of plastic from which is cut slots 28, canted second end 26 and prongs 34 and 35. Between the cut slots 28 remains glider or slides 36, which provides a contact surface on which the nozzle is supported during a vacuuming operation. Canted second end 26 is closed with adhesively secured covering plate 30 on which permanent magnet 32 is attached.

FIG. 5 illustrates tthe vacuum cleaner itself which comprises elbow-shaped housing 38 having first leg 40 and second leg 42. Fitted inside of the housing is vacuum blower 44 outlined by the hidden lines, and filter bag 46 also outlined by the hidden lines. The filter bag is encased in second leg 42 of the housing which is closed by removable cover 48. Vacuum blower means 44 is encased in first leg 40 which is closed by exhaust screen 50.

Removable cover 16 is releasably secured to second leg 42 by latch means 52. The lip of the filter bag may be secured between the end of housing 38 and the removable cover. The removable cover also comprises an aperture into which the end of flexible hose 14 is frictionally fitted.

The vacuum blower means comprises an electric blower motor which is supplied electricity from any conventional outlet through electric cable 54. On/off switch 56 is used to switch the blower motor on and off as desired by the operator.

At the base of first leg 40 is exhaust screen 50. Footings 58 prevent exhaust screen 50 from resting flush against any surface which would prevent proper ventilation of the blower motor. Deodorant chamber 60 is secured against exhaust screen 50 and is provided with a series of apertures 62, from which deodorant odor or scented powder can be released.

The operator carries vacuum cleaner 10 by a carrying means which comprises ears 64 and 65 and carrying strap 66. Ear 64 is mounted on second leg 42 of housing 38 and ear 65 is mounted on first leg 40. Both ears provide mounting points for carrying strap 66. The carrying strap may be adjusted in any conventional manner to insure that cleaner 10 hangs at the proper level for the operator. In addition to the carrying strap the carrying means comprise handle 68 which is mounted to housing 38 at points 69 and 70.

A vacuum or suction is formed at attachment nozzle 20 by withdrawing air through suction tube 16 and flexible hose 14 by vacuum blower 44. Dust, dirt and other particles entrained in the air flow are trapped by disposable filter bag 46. If too many particles are trapped thereby clogging the filter bag and restricting air flow through the housing, the bag can be removed and replaced with a fresh bag.

As already discussed vacuuming is accomplished by moving attachment nozzle 20 in a sweeping motion from side-to-side whereby dirt particles entrapped in a carpet or other surface are exposed to a suction at slots 28. Dirt particles are pulled-up into the interior of the cylindrical tube and into the vacuum. A difficult problem associated with vacuuming thick carpets in offices is paper clips, staples and other articles that get entrapped in the fibrous material of the carpet, so tightly, that simple vacuuming will not free them. The present attachment means provides a solution to this problem, by providing prongs 34 and 35 which can be used to work the paper clips and staples loose, as illustrated in FIG. 6. The operator manipulates the suction tube so that the prongs contact clips C and loosen the hold of the entrapping fibers. Permanent magnet 32 can then be used to attract and hold all metal objects so released. The manipulation of the clips by the prong means can be accomplished while the operator is standing up and therefore wasteful bending and awkward squatting is eliminated increasing operator efficiency.

Both the vacuum cleaner and the attachment means can be used independently of one another but are designed to provide peak efficiency when utilized together. So while the present invention has been disclosed in connection with the illustrated embodiments, it is not be so limited but is to be limited solely by the claims which follow.

I claim:

1. A portable operator carried vacuum cleaner for cleaning surfaces, comprising:

an elbow-shaped housing having a first leg and a second leg;

vacuum blower means located within the first leg of said housing for creating a vacuum in said housing;

filter bag means, located within the second leg of the housing, for trapping matter drawn into said vacuum cleaner by said vacuum generated by said vacuum blower means; and carrying means attached to said housing for assisting the operator in carrying said vacuum cleaner during vacuuming, the carrying means comprises first and second securing ears and a carrying strap, the first securing ear is mounted on the first leg of the housing and the second ear is mounted on the second leg of the housing, the carrying strap is attached to the ears and is so constructed that the first leg of the housing extends generally vertically in a downward direction from the second leg of the housing which extends generally horizontally during a vacuuming operation.

2. A portable vacuum cleaner in accordance with claim 1 wherein said first leg comprises an exhaust screen through which said vacuum blower means is exhausted.

3. A portable vacuum cleaner in accordance with claim 2 wherein said second leg comprises a removable cover having an aperture.

4. A portable vacuum cleaner in accordance with claim 3 wherein said removable cover is secured to said second leg of said housing by latching means.

5. A portable vacuum cleaner in accordance with claim 4 wherein said carrying means further comprises a handle which is attached to said housing means.

6. A portable vacuum cleaner in accordance with claim 5 further comprising footings mounted to said first leg so that said exhaust screen will not sit flush against any surface which prevents said vacuum blower means from overheating from improper ventilation.

7. A portable vacuum cleaner in accordance with claim 6 wherein said exhaust screen further comprises a deodorant housing which distributes a deodorant around the area to be vacuumed by the exhaust of said vacuum blower means.

8. A portable vacuum cleaner in accordance with claim 7 wherein said housing is formed from plastic.

9. A portable vacuum cleaner in accordance with claim 8 further comprising a flexible hose that is frictionally fitted into said aperture of said removable cover.

10. A portable vacuum cleaner in accordance with claim 9 further comprising a suction tube having a first end which is coupled to said flexible hose and a second end which is coupled to a 45° coupling.

11. A portable vacuum cleaner in accordance with claim 10 wherein said 45° coupling is coupled to an attachment nozzle, so that when an operator is manipulating said suction tube from a standing position said attachment means is adjacent and parallel to the surface to be cleaned.

12. A portable vacuum cleaner in accordance with claim 11 wherein said suction tube is a transparent plastic tube, so that the flow of material can be monitored.

13. A portable vacuum cleaner in accordance with claim 12 wherein said nozzle attachment comprises a tube that is longitudinally coupled to said suction tube and which is provided with longitudinal slots for transmitting the vacuum transmitted through said flexible hose and said suction tube to said surface to be cleaned.

14. A portable vacuum cleaner in accordance with claim 13 wherein an operator moves said attachment nozzle side-to-side during a vacuuming operation.

15. A portable vacuum cleaner in accordance with claim 14 wherein said nozzle attachment further comprises a magnetic means for magnetically attracting metal objects on said surface to be cleaned.

16. A portable vacuum cleaner in accordance with claim 15 wherein said nozzle attachment is further provided with prongs for manipulating matter entrained in the surface to be cleaned.

* * * * *